US009741303B2

(12) United States Patent
Kim et al.

(10) Patent No.: US 9,741,303 B2
(45) Date of Patent: Aug. 22, 2017

(54) DISPLAY APPARATUS WITH DECREASED AFTERIMAGE

(71) Applicant: Samsung Display Co., LTD., Yongin, Gyeonggi-Do (KR)

(72) Inventors: Kwi-Hyun Kim, Yongin-si (KR); Dae-Cheol Kim, Hwaseong-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 141 days.

(21) Appl. No.: 14/736,642

(22) Filed: Jun. 11, 2015

(65) Prior Publication Data

US 2016/0180792 A1 Jun. 23, 2016

(30) Foreign Application Priority Data

Dec. 23, 2014 (KR) ..... 10-2014-0187252

(51) Int. Cl.
*G09G 3/36* (2006.01)

(52) U.S. Cl.
CPC ..... *G09G 3/3648* (2013.01); *G09G 3/3614* (2013.01); *G09G 2300/0452* (2013.01); *G09G 2300/0876* (2013.01)

(58) Field of Classification Search
None
See application file for complete search history.

(56) References Cited

U.S. PATENT DOCUMENTS

| | | | | |
|---|---|---|---|---|
| 5,825,343 | A | 10/1998 | Moon | |
| 6,680,722 | B1 * | 1/2004 | Hiraki | G09G 3/2011 345/87 |
| 2007/0146283 | A1 * | 6/2007 | Hong | G09G 3/007 345/98 |
| 2013/0248869 | A1 * | 9/2013 | Chang | H01L 33/08 257/59 |
| 2014/0333516 | A1 * | 11/2014 | Park | G09G 3/3614 345/89 |
| 2015/0103064 | A1 * | 4/2015 | Hwang | G09G 3/3648 345/212 |
| 2015/0154931 | A1 * | 6/2015 | Shin | G09G 3/3648 345/210 |

FOREIGN PATENT DOCUMENTS

| | | | |
|---|---|---|---|
| KR | 1020090067522 | A | 6/2009 |
| KR | 1020120139451 | A | 12/2012 |
| KR | 1020140075631 | A | 6/2014 |

* cited by examiner

*Primary Examiner* — David D Davis
(74) *Attorney, Agent, or Firm* — Cantor Colburn LLP

(57) ABSTRACT

A display apparatus includes a display panel which includes a gate line, a data line and a storage line, and displays an image, a gate driving part configured to output a gate signal to the gate line, a data driving part configured to output a data signal based on an image data of the image to the data line, and a voltage providing part configured to apply an alternating current voltage to the storage line.

19 Claims, 9 Drawing Sheets

DISPLAY APPARATUS WITH DECREASED AFTERIMAGE

This application claims priority to Korean Patent Application No. 10-2014-0187252, filed on Dec. 23, 2014, and all the benefits accruing therefrom under 35 U.S.C. §119, the contents of which are herein incorporated by reference in their entireties.

BACKGROUND

1. Field

Exemplary embodiments of the invention relate to a display apparatus. More particularly, exemplary embodiments of the invention relate to a display apparatus displaying an image.

2. Description of the Related Art

A display apparatus such as a liquid crystal display apparatus generally includes a display panel and a display panel driving apparatus.

The display panel includes a gate line extending in a first direction, a data line extending in a second direction substantially perpendicular to the first direction, and a pixel defined by the gate line and the data line.

The display panel driving apparatus includes a gate driving part outputting a gate signal to the gate line, a data driving part outputting a data signal to the data line, and a timing controlling part controlling timings of the gate driving part and the data driving part.

The data voltage is decreased when the gate signal is decreased from a high level to a low level while a data voltage of the data signal is charged to the pixel. Therefore, a kickback voltage is generated, and thus a vertical line flicker is generated on the display panel.

SUMMARY

Exemplary embodiments of the invention provide a display apparatus capable of improving display quality of the display apparatus.

According to an exemplary embodiment of the invention, a display apparatus includes a display panel, a gate driving part, a data driving part and a voltage providing part. The display panel includes a gate line, a data line and a storage line, and displays an image. The gate driving part is configured to output a gate signal to the gate line. The data driving part is configured to output a data signal based on an image data of the image to the data line. The voltage providing part is configured to apply an alternating current ("AC") voltage to the storage line.

In an exemplary embodiment, the display panel may further include a first unit pixel including a first pixel and a second pixel, and a second unit pixel including a third pixel and a fourth pixel, and each of the first unit pixel and the second unit pixel may include a first thin film transistor electrically connected to the gate line and the data line, overlapping the storage line and electrically connected to a first pixel electrode of the first pixel, a second thin film transistor electrically connected to the gate line and the data line and electrically connected to a second pixel electrode of the second pixel, and a third thin film transistor electrically connected to the gate line and the second thin film transistor and electrically connected to the second pixel electrode of the second pixel.

In an exemplary embodiment, the first pixel may be a red pixel, the second pixel may be a green pixel, the third pixel may be a blue pixel and the fourth pixel may be a white pixel.

In an exemplary embodiment, the storage line may include a first storage line extending in a first direction in which the gate line extends, and a second storage line extending in a second direction in which the data line extends. The third thin film transistor may be electrically connected to the second storage line.

In an exemplary embodiment, the display panel may further include a gate insulating layer disposed on the storage line, a channel layer disposed on the gate insulating layer, and a source-drain layer disposed on the channel layer. A polarity of a data voltage applied to the source-drain layer may be changed in each frame period.

In an exemplary embodiment, the frame periods may include a first frame period and a second frame period subsequent to the first frame period, the first frame period may include a positive polarity charging period and a first blank period subsequent to the positive polarity charging period, the second frame period may include a negative polarity charging period and a second blank period subsequent to the negative polarity charging period, and the data voltage may have a first level of a positive polarity during the positive polarity charging period, have a second level of a negative polarity during the negative polarity charging period, and have the first level during the first blank period and the second blank period, where the positive polarity and the negative polarity are with reference to a common voltage.

In an exemplary embodiment, a storage voltage applied to the storage line may have a third level during the positive polarity charging period and the negative polarity charging period, and have a fourth level lower than the third level and between the first level and the second level during the first blank period and the second blank period.

In an exemplary embodiment, a difference between the fourth level of the storage voltage and the first level of the data voltage may be a negative value during the first blank period and the second blank period, and a difference between the third level of the storage voltage and the second level of the data voltage may be a positive value during the negative polarity charging period.

In an exemplary embodiment, a difference between a first absolute value of the negative value and a second absolute value of the positive value may be less than a reference value.

In an exemplary embodiment, the first level may be about 16 volts, the second level may be about 0 volt, the third level may be about 15 volts, the fourth level may be about 5 volts, and the reference value may be about 5 volts.

In an exemplary embodiment, the display apparatus may further include an image analyzing part and a frame dividing part. The image analyzing part may analyze a grayscale of the image data and output a grayscale data. The frame dividing part may output a high grayscale frame signal which indicates a frame having a grayscale value higher than an average grayscale value of the image data and a low grayscale frame signal which indicates a frame having a grayscale value lower than the average grayscale value of the image data, based on the grayscale data. The voltage providing part may apply a first AC voltage to the storage line in response to the high grayscale frame signal and apply a second AC voltage to the storage line in response to the low grayscale frame signal.

In an exemplary embodiment, the display panel may include a gate insulating layer disposed on the storage line, a channel layer disposed on the gate insulating layer, and a source-drain layer disposed on the channel layer. A polarity of a data voltage applied to the source-drain layer may be changed in each frame period.

In an exemplary embodiment, the frame periods may include a first frame period and a second frame period subsequent to the first frame period, the first frame period may include a positive polarity charging period and a first blank period subsequent to the positive polarity charging period, the second frame period may include a negative polarity charging period and a second blank period subsequent to the negative polarity charging period. When the frame dividing part outputs the high grayscale frame signal, the data voltage may have a first level of a positive polarity during the positive polarity charging period and the first blank period, and have a second level of a negative polarity during the negative polarity charging period and the second blank period, and a storage voltage applied to the storage line may have a third level during the positive polarity charging period and the negative polarity charging period and have a fourth level lower than the third level and between the first level and the second level during the first blank period and the second blank period, where the positive polarity and the negative polarity are with reference to a common voltage.

In an exemplary embodiment, a difference between the fourth level of the storage voltage and the first level of the data voltage may be a negative value during the first blank period, and a difference between the fourth level of the storage voltage and the second level of the data voltage may be a positive value during the second blank period.

In an exemplary embodiment, when the frame dividing part outputs the low grayscale frame signal, the data voltage may have a fifth level of the positive polarity during the positive polarity charging period, have a sixth level higher than the fifth level during the first blank period, have a seventh level of the negative polarity during the negative polarity charging period, and have an eighth level lower than the seventh level during the second blank period, and the storage voltage may have a ninth level during the positive polarity charging period and the negative polarity charging period, and have a tenth level lower than the ninth level and between the sixth level and the eighth level during the first blank period and the second blank period.

In an exemplary embodiment, a difference between the tenth level of the storage voltage and the sixth level of the data voltage may be a negative value during the first blank period, and a difference between the tenth level of the storage voltage and the eighth level of the data voltage may be a positive value during the second blank period.

In an exemplary embodiment, the frame periods may include a first frame period and a second frame period subsequent to the first frame period, the first frame period may include a positive polarity charging period and a first blank period subsequent to the positive polarity charging period, the second frame period may include a negative polarity charging period and a second blank period subsequent to the negative polarity charging period. When the frame dividing part outputs the high grayscale frame signal, the data voltage may have a first level of a positive polarity during the positive polarity charging period and the first blank period, and have a second level of a negative polarity during the negative polarity charging period and the second blank period, and a storage voltage applied to the storage line may have a third level between the first level and the second level during the positive polarity charging period, the first blank period, the negative polarity charging period and the second blank period, where the positive polarity and the negative polarity are with reference to a common voltage.

In an exemplary embodiment, when the frame dividing part outputs the low grayscale frame signal, the data voltage may have a fourth level of the positive polarity during the positive polarity charging period and the first blank period, and have a fifth level of the negative polarity during the positive polarity charging period and the second blank period, and the storage voltage may have a sixth level higher than the fourth level and the fifth level during the positive polarity charging period, the first blank period, the negative polarity charging period and the second blank period.

In an exemplary embodiment, the display apparatus may further include an image analyzing part and a frame dividing part. The image analyzing part may analyze a luminance of the image data and output a luminance data. The frame dividing part may output a high luminance frame signal which indicates a frame having a luminance value higher than an average luminance value of the image data and a low luminance frame signal which indicates a frame having a luminance value lower than the average luminance value of the image data, based on the luminance data. The voltage providing part may apply a first AC voltage to the storage line in response to the high luminance frame signal and apply a second AC voltage to the storage line in response to the low luminance frame signal.

Typically, the kickback voltage is in inverse proportion to a storage voltage applied to a storage line in the display panel. Therefore, in order to decrease the kickback voltage, when the storage voltage is increased, the vertical line flicker may be decreased. However, when the storage voltage is increased, an afterimage is displayed on the display panel, and thus display quality of the display apparatus including the display panel may be degraded.

However, according to the invention, an afterimage of an image displayed on a display panel may be decreased, and thus display quality of a display apparatus may be improved.

BRIEF DESCRIPTION OF THE DRAWINGS

The above and other features and advantages of the invention will become more apparent by describing in detailed example embodiments thereof with reference to the accompanying drawings, in which.

DETAILED DESCRIPTION

Figure 1:
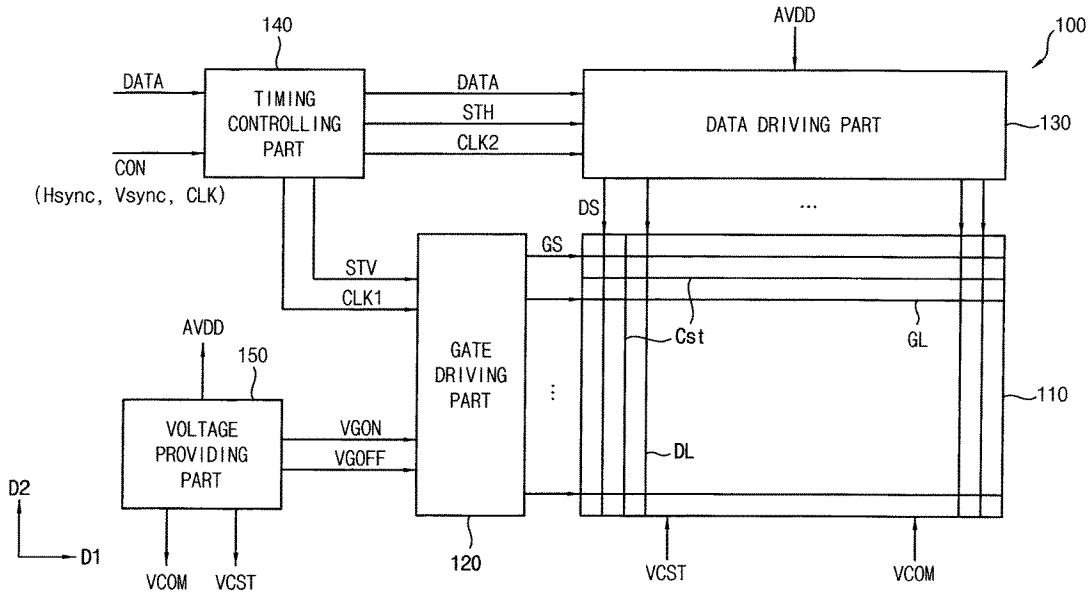
FIG. 1 is a block diagram illustrating an exemplary embodiment of a display apparatus according to the invention.

Hereinafter, the invention will be explained in detail with reference to the accompanying drawings.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

FIG. 1 is a block diagram illustrating a display apparatus according to an exemplary embodiment of the invention.

Referring to FIG. 1, the display apparatus 100 according to the illustrated exemplary embodiment includes a display panel 110, a gate driving part 120, a data driving part 130, a timing controlling part 140 and a voltage providing part 150.

The display panel 110 receives a data signal DS based on an image data DATA provided from the timing controlling part 140 to display an image. In an exemplary embodiment, the image data DATA may be a two-dimensional ("2D") plane image data. Alternatively, the image data DATA may include a left-eye image data and a right-eye image data for displaying a three-dimensional ("3D") stereoscopic image, for example.

The display panel 110 includes gate lines GL, data lines DL and a plurality of pixels. The gate lines GL extend in a first direction D1 and are arranged in a second direction D2 substantially perpendicular to the first direction D1. The data lines DL extend in the second direction D2 and are arranged in the first direction D1. In addition, the display panel 110 includes a storage line Cst extending in the first direction D1 and the second direction D2.

The gate driving part 120, the data driving part 130, the timing controlling part 140 and the voltage providing part 150 may be defined as a display panel driving apparatus driving the display panel 110.

The gate driving part 120 generates a gate signal GS in response to a gate start signal STV and a gate clock signal CLK1 provided from the timing controlling part 140, and outputs the gate signal GS to the gate line GL. The gate driving part 120 may generate the gate signal GS using a gate on voltage VGON and a gate off voltage VGOFF provided from the voltage providing part 150.

The data driving part 130 outputs a data signal DS to the data line DL in response to a data start signal STH and a data clock signal CLK2 provided from the timing controlling part 140. The data driving part 130 may output the data signal DS using a data driving voltage AVDD provided from the voltage providing part 150.

The timing controlling part 140 receives the image data DATA and a control signal CON from an outside. The control signal CON may include a horizontal synchronous signal Hsync, a vertical synchronous signal Vsync and a clock signal CLK. The timing controlling part 140 generates the data start signal STH using the horizontal synchronous signal Hsync and outputs the data start signal STH to the data driving part 130. In addition, the timing controlling part 140 generates the gate start signal STV using the vertical synchronous signal Vsync and outputs the gate start signal STV to the gate driving part 120. In addition, the timing controlling part 140 generates the gate clock signal CLK1 and the data clock signal CLK2 using the clock signal CLK, outputs the gate clock signal CLK1 to the gate driving part 120, and outputs the data clock signal CLK2 to the data driving part 130.

The voltage providing part 150 outputs the gate on voltage VGON and the gate off voltage VGOFF to the gate driving part 120. In addition, the voltage providing part 150 outputs the data driving voltage AVDD to the data driving part 130. In addition, the voltage providing part 150 outputs a storage voltage VCST to the storage line Cst of the display panel 110. In addition, the voltage providing part 150 outputs a common voltage VCOM to a common electrode in the display panel 110.

Figure 2:
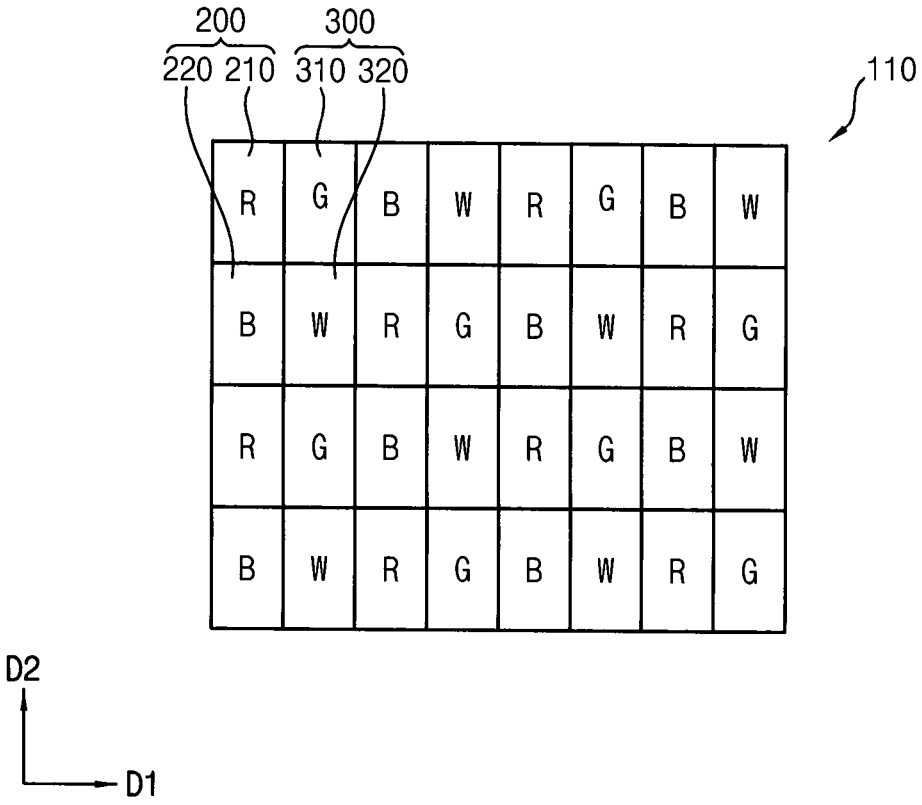
FIG. 2 is a plan view illustrating a display panel of FIG. 1.

FIG. 2 is a plan view illustrating the display panel 110 of FIG. 1.

Referring to FIG. 2, the display panel 110 includes a first unit pixel 200 and a second unit pixel 300. The first unit pixel 200 includes a first pixel 210 and a second pixel 220. The second unit pixel 300 includes a third pixel 310 and a fourth pixel 320. In an exemplary embodiment, the first pixel 210 may be a red pixel, the second pixel 220 may be a blue pixel, the third pixel 310 may be a green pixel, and the fourth pixel 320 may be a white pixel, for example. Thus, an opening ratio of the display panel 110 is higher than that of a display panel in which a white pixel is not included.

Figure 3:
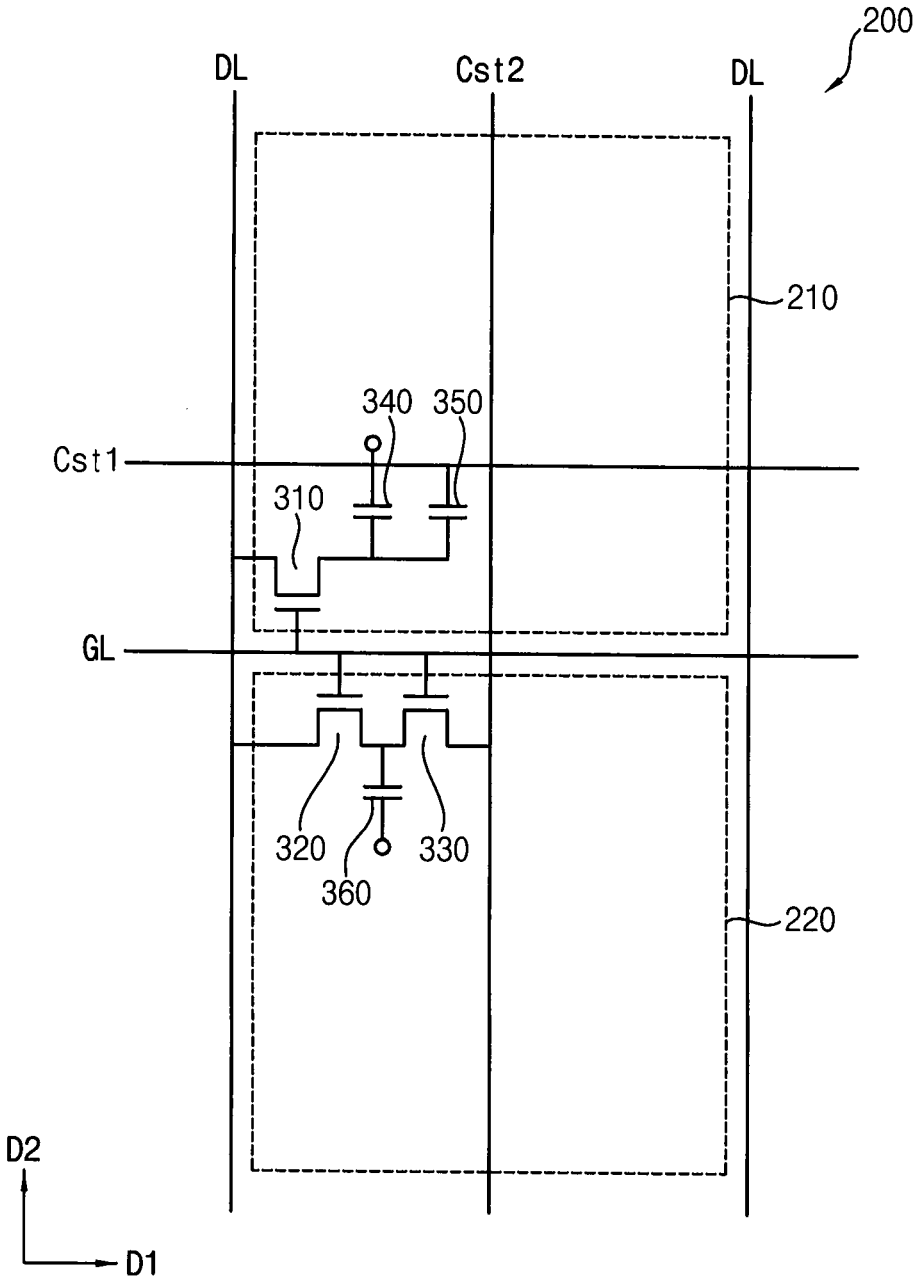
FIG. 3 is a circuit diagram illustrating a first unit pixel of FIG. 2.

FIG. 3 is a circuit diagram illustrating the first unit pixel 200 of FIG. 2.

Referring to FIGS. 1 to 3, the first unit pixel 200 includes the first pixel 210 and the second pixel 20. The first pixel 210 is disposed at an upper side of the gate line GL, and the second pixel 220 is disposed at a lower side of the gate line GL in a plan view. Thus, the first pixel 210 may be referred to a high pixel, and the second pixel 220 may be referred to a low pixel.

In addition, the storage line Cst of the display panel 110 includes a first storage line Cst1 and a second storage line Cst2. The first storage line Cst1 is spaced apart from the gate line GL and extends in the first direction D1. The second storage line Cst2 is spaced apart from the data line DL and extends in the second direction D2.

The first pixel 210 includes a first thin film transistor ("TFT") 310, a first liquid crystal capacitor 340 and a first storage capacitor 350. The first TFT 310 is electrically connected to the gate line GL and the data line DL. In addition, the first TFT 310 is electrically connected to the first liquid capacitor 340 and the first storage capacitor 350.

The second pixel 220 includes a second TFT 320, a third TFT 330 and a second liquid crystal capacitor 360. The second TFT 320 is electrically connected to the gate line GL and the data line DL. In addition, the second TFT 320 is electrically connected to the third TFT 330 and the second liquid capacitor 360. The third TFT 330 is electrically connected to the gate line GL and the second TFT 320. In addition, the third TFT 330 is electrically connected to the second storage line Cst2 and the second liquid crystal capacitor 360.

Figure 4:
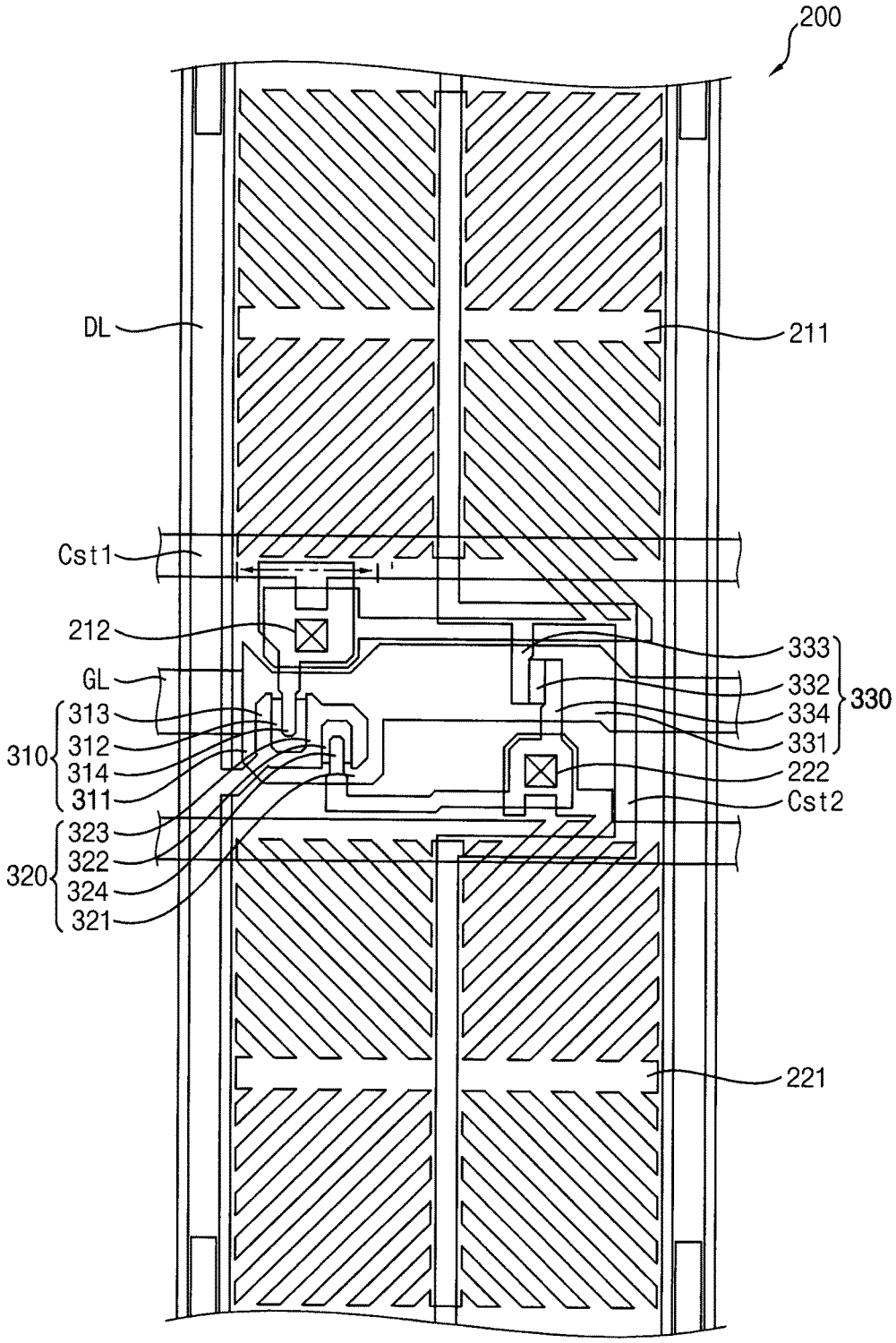
FIG. 4 is a plan view illustrating the first unit pixel of FIGS. 2 and 3.

FIG. 4 is a plan view illustrating the first unit pixel 200 of FIGS. 2 and 3.

Referring to FIGS. 3 and 4, the first TFT 310 includes a first gate electrode 311, a first channel layer 312, a first source electrode 313 and a first drain electrode 314. The first gate electrode 311 is electrically connected to the gate line GL. The first channel layer 312 connects the first source electrode 313 and the first drain electrode 314. The first channel layer 312 may include a first semiconductor layer and a first ohmic contact layer. The first source electrode 313 is electrically connected to the data line DL. The first drain electrode 314 is electrically connected to a first pixel electrode 211 of the first pixel 210 through a first contact hole 212 and overlaps the first storage line Cst1.

The second TFT 320 includes a second gate electrode 321, a second channel layer 322, a second source electrode 323 and a second drain electrode 324. The second gate electrode 321 is electrically connected to the gate line GL. The second channel layer 322 connects the second source electrode 323 and the second drain electrode 324. The second channel layer 322 may include a second semiconductor layer and a second ohmic contact layer. The second source electrode 323 is electrically connected to the data line DL. The second drain electrode 324 is electrically connected to a second pixel electrode 221 of the second pixel 220 through a second contact hole 222.

The third TFT 330 includes a third gate electrode 331, a third channel layer 332, a third source electrode 333 and a third drain electrode 334. The third gate electrode 331 is electrically connected to the gate line GL. The third channel layer 332 connects the third source electrode 333 and the third drain electrode 334. The third channel layer 332 may include a third semiconductor layer and a third ohmic contact layer. The third source electrode 333 is electrically connected to the second storage line Cst2. The third drain electrode 334 is electrically connected to the second pixel electrode 221 of the second pixel 220 through the second contact hole 222.

Figure 5:
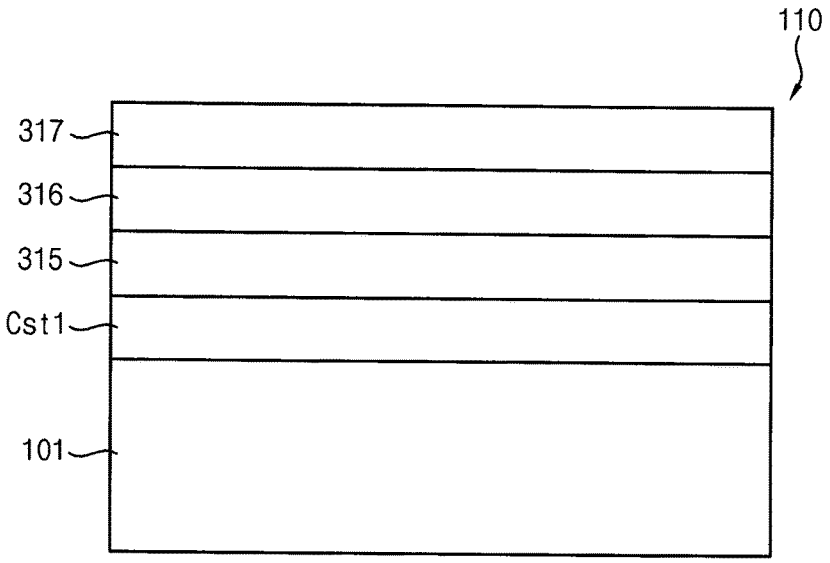
FIG. 5 is a cross-sectional view taken along a line I-I' of FIG. 4.

FIG. 5 is a cross-sectional view taken along a line I-I' of FIG. 4.

Referring to FIGS. 1 to 5, the display panel 110 may include a base substrate 101, the first storage line Cst1, a gate insulating layer 315, a channel layer 316 and a source-drain layer 317.

In an exemplary embodiment, the base substrate 101 may be a glass substrate or a plastic substrate. The first storage line Cst1 is disposed on the base substrate 101. The gate insulating layer 315 is disposed on the first storage line Cst1. The gate insulating layer 315 may cover the first gate electrode 311 of the first TFT 310, the second gate electrode 321 of the second TFT 320 and the third gate electrode 331 of the third TFT 330. The channel layer 316 is disposed on the gate insulating layer 315. The channel layer 316 may include the first channel layer 312 of the first TFT 310, the second channel layer 322 of the second TFT 320 and the third channel layer 332 of the third TFT 330. The source-drain layer 317 is disposed on the channel layer 316. The source-drain layer 317 may include the first source electrode 313 and the first drain electrode 314 of the first TFT 310, the second source electrode 323 and the second drain electrode 324 of the second TFT 320, and the third source electrode 333 and the third drain electrode 334 of the third TFT 330.

Figure 6:
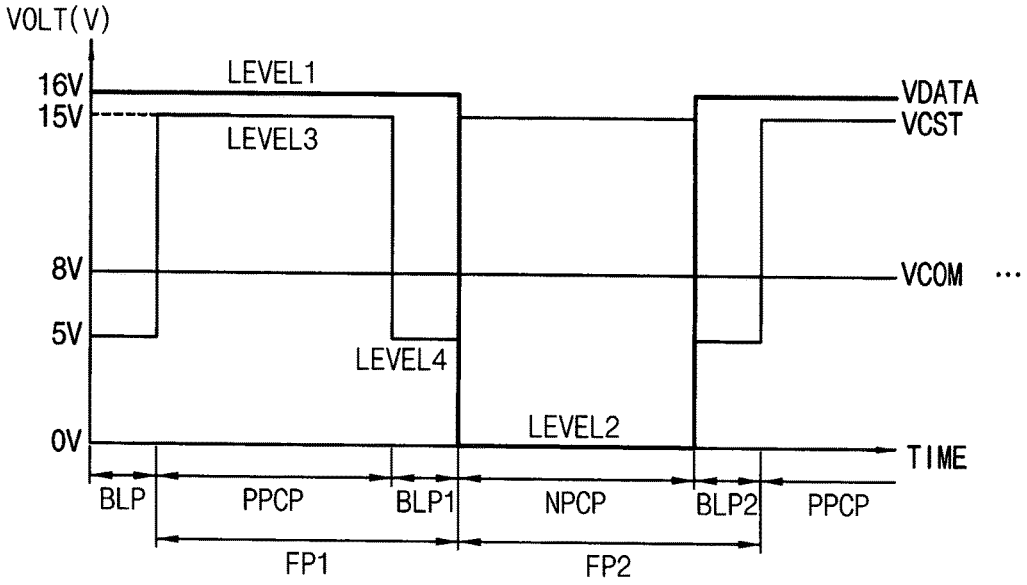
FIG. 6 is a waveform diagram illustrating a data voltage of a data signal of FIG. 1, a storage voltage applied to a storage line of FIG. 1 and a common voltage applied to a common electrode in the display panel of FIG. 1.

FIG. 6 is a waveform diagram illustrating a data voltage VDATA of the data signal DS of FIG. 1, the storage voltage VCST applied to the storage line Cst of FIG. 1 and the common voltage VCOM applied to the common electrode in the display panel 110 of FIG. 1.

Referring to FIGS. 1 and 6, the data voltage VDATA may be applied to the source-drain layer 317, and the storage voltage VCST may be applied to the first storage line Cst1. The data voltage VDATA and the storage voltage VCST may be controlled by the voltage providing part 150.

A polarity of the data voltage VDATA may be changed in each frame period. Specifically, the frame periods may include a first frame period FP1 and a second frame period FP2 subsequent to the first frame period FP1. The first frame period FP1 may include a positive polarity charging period PPCP and a first blank period BLP1 subsequent to the positive polarity charging period PPCP. The data voltage VDATA has a first level LEVEL1 higher than that of the common voltage VCOM during the positive polarity charging period PPCP. Thus, the data voltage VDATA has a positive polarity during the positive polarity charging period PPCP. In an exemplary embodiment, the level of the common voltage VCOM may be about 8 volts, and the first level LEVEL1 may be about 16 volts, for example. The second frame period FP2 may include a negative polarity charging period NPCP and a second blank period BLP2 subsequent to the negative polarity charging period NPCP. The data voltage VDATA has a second level LEVEL2 lower than that of the common voltage VCOM during the negative polarity charging period NPCP. Thus, the data voltage VDATA has a negative polarity with regard to the common voltage VCOM during the negative polarity charging period NPCP. In an exemplary embodiment, the second level LEVEL2 may be about 0 volt, for example. The data voltage VDATA has the first level LEVEL1 during the first blank period BLP1 and the second blank period BLP2.

The storage voltage VCST may be an alternating current ("AC") voltage. Specifically, the storage voltage VCST has a third level LEVEL3 during the positive polarity charging period PPCP and the negative polarity charging period NPCP and has a fourth level LEVEL4 lower than the third level LEVEL3 and between the first level LEVEL1 and the second level LEVEL2 during the first blank period BLP1 and the second blank period BLP2. In an exemplary embodiment, the third level LEVEL3 may be about 15 volts, and the fourth level LEVEL4 may be 5 volts, for example.

When, a difference between the fourth level LEVEL4 of the storage voltage VCST and the first level LEVEL1 of the data voltage VDATA is a negative value during the first blank period BLP1 and the second blank period BLP2. A difference between the third level LEVEL3 of the storage voltage VCST and the second level LEVEL2 of the data voltage VDATA is a positive value during the negative polarity charging period NPCP. Here, a difference between a first absolute value of the negative value and a second absolute value of the positive value may be less than a reference value. In an exemplary embodiment, the first level LEVEL1 may be about 16 volts, the second level LEVEL2 may be about 0 volt, the third level LEVEL3 may be about 15 volts, the fourth level LEVEL4 may be about 5 volts, the negative value may be about −11 volts, the positive value may be about 15 volts, the first absolute value may be about 11 volts, the second absolute value may be about 15 volts, and the reference value may be about 5 volts, for example.

An effective voltage which is a difference between the storage voltage VCST and the data voltage VDATA is applied to an interface between the first storage line Cst1 and the gate insulating layer 315.

According to the illustrated exemplary embodiment, the effective voltage applied to the interface between the first storage line Cst1 and the gate insulating layer 315 is the negative value during the first blank period BLP1 and the second blank period BLP2. In addition, the effective voltage applied to the interface between the first storage line Cst1 and the gate insulating layer 315 is the positive value during the negative polarity charging period NPCP. In addition, the value between the first absolute value of the negative value and the second absolute value of the positive value is less than the reference value. Thus, a charge trapping at the interface between the first storage line Cst1 and the gate insulating layer 315 may be decreased. Therefore, an after-image of the image displayed on the display panel 110 may be decreased, and thus display quality of the display apparatus 100 may be improved.

Figure 7:
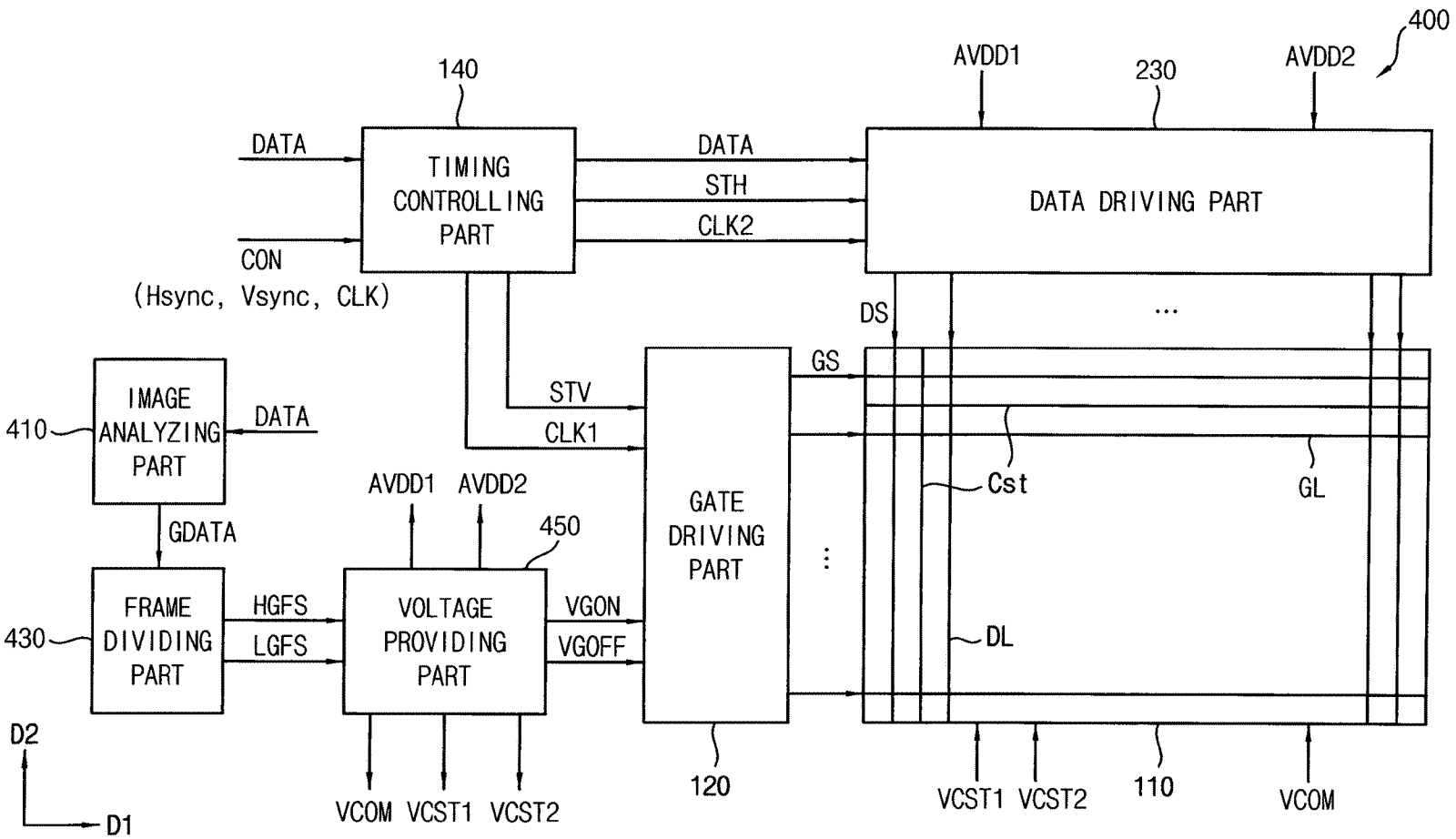
FIG. 7 is a block diagram illustrating an exemplary embodiment of a display apparatus according to the invention.

FIG. 7 is a block diagram illustrating a display apparatus according to an exemplary embodiment of the invention.

The display apparatus 400 according to the illustrated exemplary embodiment is substantially the same as the display apparatus 100 according to the previous exemplary embodiment illustrated in FIG. 1 except for a data driving part 230, an image analyzing part 410, a frame dividing part 430 and a voltage providing part 450. Thus, the same reference numerals may be used to refer to same or like parts as those described in the previous exemplary embodiment and any further repetitive explanation concerning the above elements may be omitted.

Referring to FIGS. 1 and 7, the display apparatus 400 according to the illustrated exemplary embodiment includes the display panel 110, the gate driving part 120, the data driving part 230, the timing controlling part 140, the image analyzing part 410, the frame dividing part 430 and the voltage providing part 450.

The gate driving part 120, the data driving part 230, the timing controlling part 140, the image analyzing part 410, the frame dividing part 430 and the voltage providing part 450 may be defined as a display panel driving apparatus driving the display panel 110.

The gate driving part 120 generates the gate signal GS in response to the gate start signal STV and the gate clock signal CLK1 provided from the timing controlling part 140, and outputs the gate signal GS to the gate line GL. The gate driving part 120 may generate the gate signal GS using a gate on voltage VGON and a gate off voltage VGOFF provided from the voltage providing part 450.

The data driving part 230 outputs the data signal DS to the data line DL in response to the data start signal STH and the data clock signal CLK2 provided from the timing controlling part 140. The data driving part 230 may output the data signal DS using a first data driving voltage AVDD1 and a second data driving voltage AVDD2 provided from the voltage providing part 450.

The image analyzing part 410 receives the image data DATA, and analyzes a grayscale of the image data DATA to output a grayscale data GDATA. The image analyzing part 410 may receive the image data DATA from an outside or the timing controlling part 140.

The frame dividing part 430 receives the grayscale data GDATA from the image analyzing part 410. The frame dividing part 430 outputs a high grayscale frame signal HGFS based on the grayscale data GDATA when a frame of the image data DATA has a grayscale value higher than an average grayscale value of the image data DATA. In addition, the frame dividing part 430 outputs a low grayscale frame signal LGFS based on the grayscale data GDATA when the frame of the image data DATA has a grayscale value lower than the average grayscale value of the image data DATA.

The voltage providing part 450 outputs the gate on voltage VGON and the gate off voltage VGOFF to the gate driving part 120. In addition, the voltage providing part 450 outputs the first data driving voltage AVDD1 to the data driving part 230 when the voltage providing part 450 receives the high grayscale frame signal HGFS from the frame dividing part 430. In addition, the voltage providing part 450 outputs the second data driving voltage AVDD2 to the data driving part 230 when the voltage providing part 450 receives the low grayscale frame signal LGFS from the frame dividing part 430. In addition, the voltage providing part 450 outputs a first storage voltage VCST1 to the storage line Cst of the display panel 110 when the voltage providing part 450 receives the high grayscale frame signal HGFS from the frame dividing part 430. In addition, the voltage providing part 450 outputs a second storage voltage VCST2 to the storage line Cst of the display panel 110 when the voltage providing part 450 receives the low grayscale frame signal LGFS from the frame dividing part 430. In addition, the voltage providing part 450 outputs a common voltage VCOM to a common electrode in the display panel 110.

The display panel 110 according to the illustrated exemplary embodiment is substantially the same as the display panel 110 of FIG. 1. Thus, the display panel 110 may include the base substrate 101, the first storage line Cst1, the gate insulating layer 315, the channel layer 316 and the source-drain layer 317 shown in FIG. 5.

Figure 8:
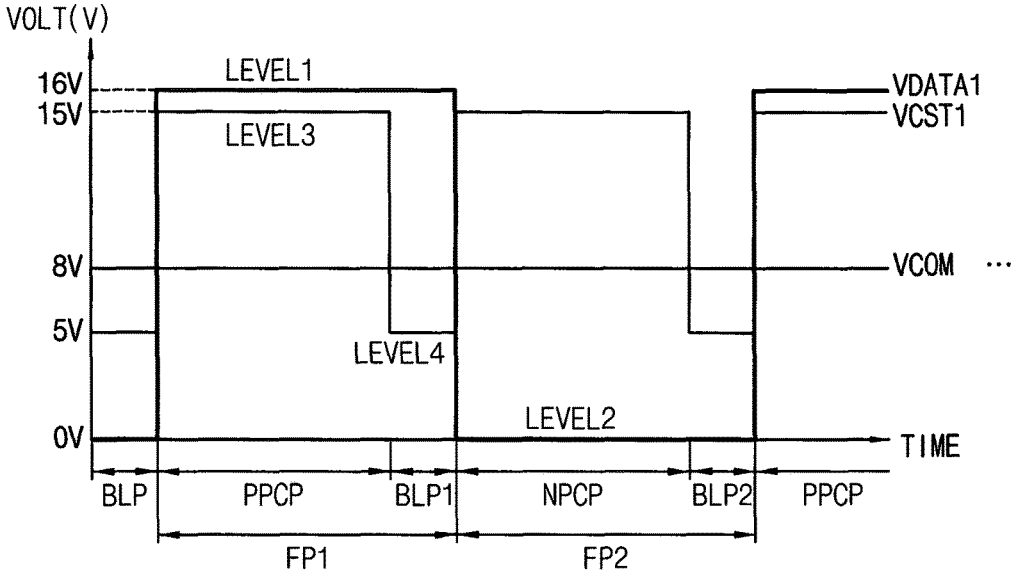
FIG. 8 is a waveform diagram illustrating a first data voltage of a data signal of FIG. 7, a first storage voltage applied to a storage line of FIG. 7 and a common voltage applied to a common electrode in a display panel of FIG. 7.

FIG. 8 is a waveform diagram illustrating a first data voltage VDATA1 of the data signal DS of FIG. 7, the first storage voltage VCST1 applied to the storage line Cst of FIG. 7 and the common voltage VCOM applied to the common electrode in the display panel 110 of FIG. 7.

Referring to FIGS. 5, 7 and 8, the first data voltage VDATA1 may be applied to the source-drain layer 317. The first storage voltage VCST1 may be applied to the first storage line Cst1. The first data voltage VDATA1 and the first storage voltage VCST1 may be controlled by the voltage providing part 450.

A polarity of the first data voltage VDATA1 may be changed in each frame period. Specifically, the frame periods may include a first frame period FP1 and a second frame period FP2 subsequent to the first frame period FP1. The first frame period FP1 may include a positive polarity charging period PPCP and a first blank period BLP1 subsequent to the positive polarity charging period PPCP. The first data voltage VDATA1 has a first level LEVEL1 higher than that of the common voltage VCOM during the positive polarity charging period PPCP and the first blank period BLP1. Thus, the first data voltage VDATA1 has a positive polarity with regard to the common voltage VCOM during the positive polarity charging period PPCP. In an exemplary embodiment, the level of the common voltage VCOM may be about 8 volts, and the first level LEVEL1 may be about 16 volts, for example. The second frame period FP2 may include a negative polarity charging period NPCP and a second blank period BLP2 subsequent to the negative polarity charging period NPCP. The first data voltage VDATA1 has a second level LEVEL2 lower than that of the common voltage VCOM during the negative polarity charging period NPCP and the second blank period BLP2. Thus, the first data voltage VDATA1 has a negative polarity with regard to the common voltage VCOM during the negative polarity charging period NPCP. In an exemplary embodiment, the second level LEVEL2 may be about 0 volt, for example.

The first storage voltage VCST1 may be an AC voltage. Specifically, the first storage voltage VCST1 has a third level LEVEL3 during the positive polarity charging period PPCP and the negative polarity charging period NPCP, and has a fourth level LEVEL4 lower than the third level LEVEL3 and between the first level LEVEL1 and the second level LEVEL2 during the first blank period BLP1 and the second blank period BLP2. In an exemplary embodiment, the third level LEVEL3 may be about 15 volts, and the fourth level LEVEL4 may be 5 volts, for example.

A difference between the fourth level LEVEL4 of the first storage voltage VCST1 and the first level LEVEL1 of the first data voltage VDATA1 is a negative value during the first blank period BLP1. A difference between the fourth level LEVEL4 of the first storage voltage VCST1 and the second level LEVEL2 of the first data voltage VDATA1 is a positive value during the second blank period BLP2. Here, a difference between a first absolute value of the negative value and a second absolute value of the positive value may be less than a first reference value. In an exemplary embodiment, the first level LEVEL1 may be about 16 volts, the second level LEVEL2 may be about 0 volt, the fourth level LEVEL4 may be about 5 volts, the negative value may be about −11 volts, the positive value may be about 5 volts, the first absolute value may be about 11 volts, the second absolute value may be about 5 volts, and the first reference value may be about 6 volts, for example.

A first effective voltage which is a difference between the first storage voltage VCST1 and the first data voltage VDATA1 is applied to an interface between the first storage line Cst1 and the gate insulating layer 315.

Figure 9:
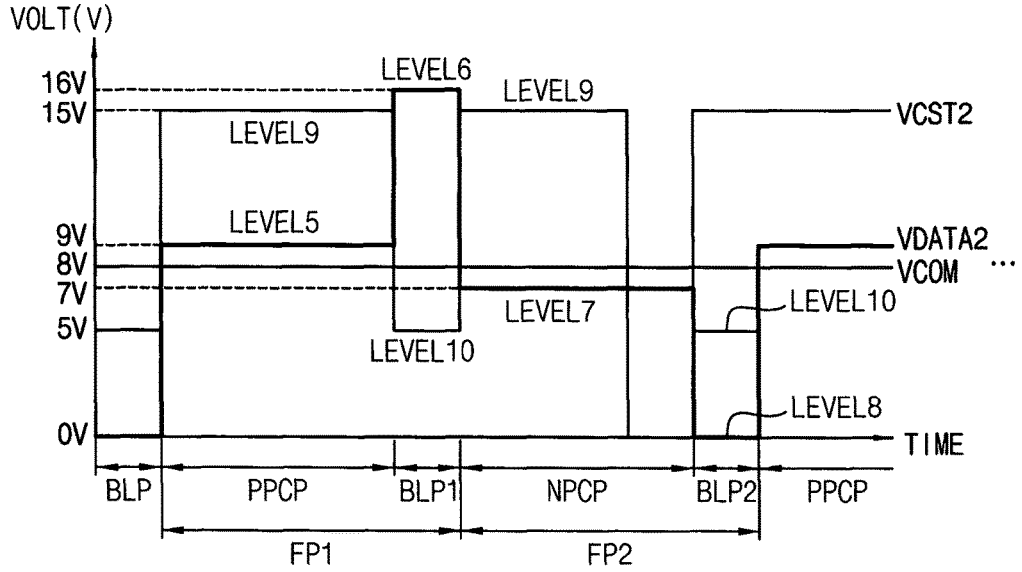
FIG. 9 is a waveform diagram illustrating a second data voltage of the data signal of FIG. 7, a second storage voltage applied to the storage line of FIG. 7 and the common voltage applied to the common electrode in the display panel of FIG. 7.

FIG. 9 is a waveform diagram illustrating a second data voltage VDATA2 of the data signal DS of FIG. 7, the second storage voltage VCST2 applied to the storage line Cst of FIG. 7 and the common voltage VCOM applied to the common electrode in the display panel 110 of FIG. 7.

Referring to FIGS. 5, 7 and 9, the second data voltage VDATA2 may be applied to the source-drain layer 317. The second storage voltage VCST2 may be applied to the first storage line Cst1. The second data voltage VDATA2 and the second storage voltage VCST2 may be controlled by the voltage providing part 450.

A polarity of the second data voltage VDATA2 may be changed in each frame period. Specifically, the frame periods may include a first frame period FP1 and a second frame period FP2 subsequent to the first frame period FP1. The first frame period FP1 may include a positive polarity charging period PPCP and a first blank period BLP1 subsequent to the positive polarity charging period PPCP. The second data voltage VDATA2 has a fifth level LEVEL5 higher than that of the common voltage VCOM during the positive polarity charging period PPCP. Thus, the second data voltage VDATA2 has a positive polarity during the positive polarity charging period PPCP. In an exemplary embodiment, the level of the common voltage VCOM may be about 8 volts, and the fifth level LEVEL5 may be about 9 volts, for example. The second data voltage VDATA2 has a sixth level LEVEL6 higher than the fifth level LEVEL5 during the first blank period BLP1. In an exemplary embodiment, the sixth level LEVEL6 may be about 16 volts, for example. The second frame period FP2 may include a negative polarity charging period NPCP and a second blank period BLP2 subsequent to the negative polarity charging period NPCP. The second data voltage VDATA has a seventh level LEVEL7 lower than that of the common voltage VCOM during the negative polarity charging period NPCP. Thus, the second data voltage VDATA2 has a negative polarity with regard to the common voltage VCOM during the negative polarity charging period NPCP. In an exemplary embodiment, the seventh level LEVEL7 may be about 7 volts, for example. The second data voltage VDATA2 has an eighth level LEVEL8 during the second blank period BLP2. In an exemplary embodiment, the eighth level LEVEL8 may be about 0 volt, for example.

The second storage voltage VCST2 may be an AC voltage. Specifically, the second storage voltage VCST2 has a ninth level LEVEL9 during the positive polarity charging period PPCP and the negative polarity charging period NPCP, and has a tenth level LEVEL10 lower than the ninth level LEVEL9 and between the sixth level LEVEL6 and the eighth level LEVEL8 during the first blank period BLP1 and the second blank period BLP2. In an exemplary embodiment, the ninth level LEVEL9 may be about 15 volts, and the tenth level LEVEL10 may be 5 volts, for example.

A difference between the tenth level LEVEL10 of the second storage voltage VCST2 and the sixth level LEVEL6 of the second data voltage VDATA2 is a negative value during the first blank period BLP1. A difference between the tenth level LEVEL10 of the second storage voltage VCST2 and the eighth level LEVEL8 of the second data voltage VDATA2 is a positive value during the second blank period BLP2. Here, a difference between a third absolute value of the negative value and a fourth absolute value of the positive value may be less than a second reference value. In an exemplary embodiment, the sixth level LEVEL6 may be about 16 volts, the eighth level LEVEL8 may be about 0 volt, the tenth level LEVEL10 may be about 5 volts, the negative value may be about −11 volts, the positive value may be about 5 volts, the third absolute value may be about 11 volts, the fourth absolute value may be about 5 volts, and the second reference value may be about 6 volts, for example.

A second effective voltage which is a difference between the second storage voltage VCST2 and the second data voltage VDATA2 is applied to an interface between the first storage line Cst1 and the gate insulating layer 315.

According to the illustrated exemplary embodiment, the first effective voltage applied to the interface between the first storage line Cst1 and the gate insulating layer 315 is the negative value during the first blank period BLP1. In addition, the first effective voltage applied to the interface between the first storage line Cst1 and the gate insulating layer 315 is the positive value during the second blank period BLP2. In addition, the difference between the first absolute value of the negative value and the second absolute value of the positive value is less than the first reference value. Thus, a charge trapping at the interface between the first storage line Cst1 and the gate insulating layer 315 may be decreased.

In addition, the second effective voltage applied to the interface between the first storage line Cst1 and the gate insulating layer 315 is the negative value during the first blank period BLP1. In addition, the second effective voltage applied to the interface between the first storage line Cst1 and the gate insulating layer 315 is the positive value during the second blank period BLP2. In addition, the difference between the third absolute value of the negative value and the fourth absolute value of the positive value is less than the second reference value. Thus, a charge trapping at the interface between the first storage line Cst1 and the gate insulating layer 315 may be decreased.

Therefore, an afterimage of the image displayed on the display panel 110 may be decreased, and thus display quality of the display apparatus 400 may be improved.

Figure 10:
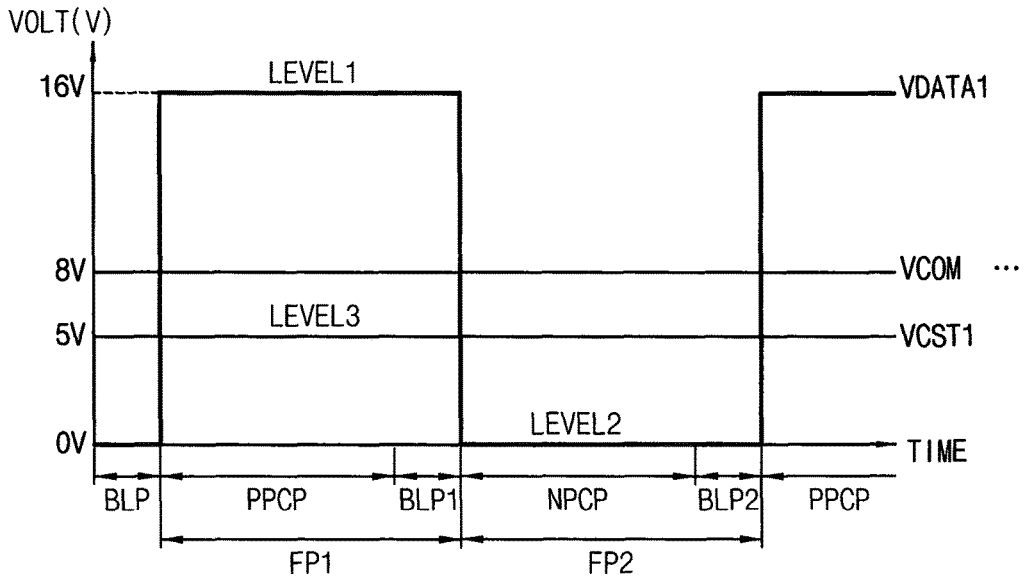
FIG. 10 is a waveform diagram illustrating an exemplary embodiment of a first data voltage, a first storage voltage and a common voltage according to the invention.
Figure 11:
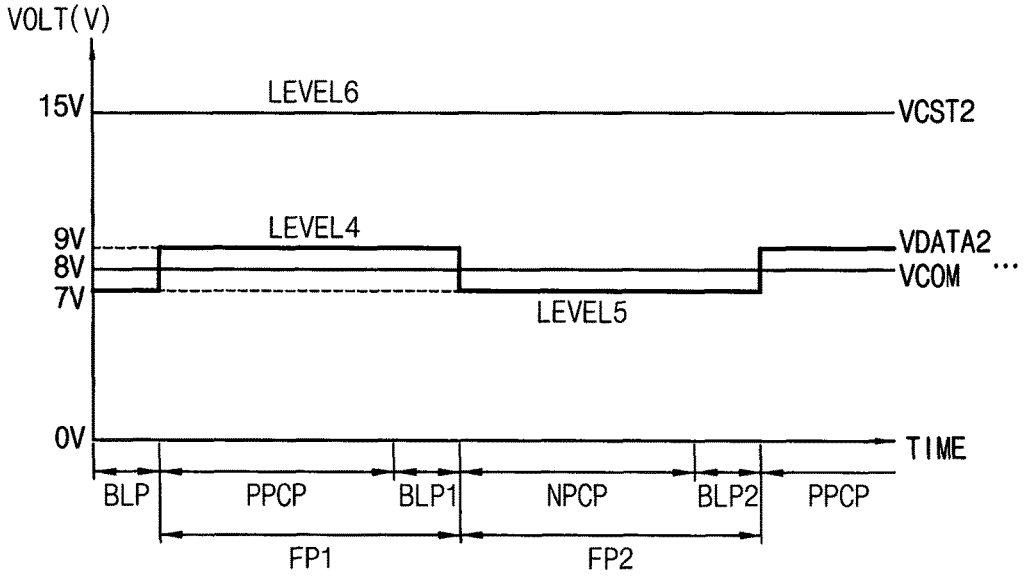
FIG. 11 is a waveform diagram illustrating an exemplary embodiment of a second data voltage, a second storage voltage and a common voltage according to the invention.

FIG. 10 is a waveform diagram illustrating a first data voltage VDATA1, a first storage voltage VCST1 and a common voltage VCOM according to an exemplary embodiment of the invention. FIG. 11 is a waveform diagram illustrating a second data voltage VDATA2, a second storage voltage VCST2 and the common voltage VCOM according to an exemplary embodiment of the invention.

The first data voltage VDATA1 and the second data voltage VDATA2 according to the illustrated exemplary embodiment may be voltages of the data signals DS output from the data driving part 230 according to the previous exemplary embodiment illustrated in FIG. 7. In addition, the first storage voltage VCST1 and the second storage voltage VCST2 according to the illustrated exemplary embodiment may be applied to the storage line Cst in the display panel 110 according to the previous exemplary embodiment illustrated in FIG. 7. In addition, the common voltage VCOM according to the illustrated exemplary embodiment may be applied to the common electrode in the display panel 110 according to the previous exemplary embodiment illustrated in FIG. 7.

Referring to FIGS. 5, 7 and 10, when the high grayscale frame signal HGFS is provided from the frame dividing part 430 to the voltage providing part 450, the first data voltage VDATA1 may be applied to the source-drain layer 317. In addition, when the high grayscale frame signal HGFS is provided from the frame dividing part 430 to the voltage providing part 450, the first storage voltage VCST1 may be applied to the first storage line Cst1. The first data voltage VDATA1 and the first storage voltage VCST1 may be controlled by the voltage providing part 450.

A polarity of the first data voltage VDATA1 may be changed in each frame period. Specifically, the frame periods may include a first frame period FP1 and a second frame period FP2 subsequent to the first frame period FP1. The first frame period FP1 may include a positive polarity charging period PPCP and a first blank period BLP1 subsequent to the positive polarity charging period PPCP. The first data voltage VDATA1 has a first level LEVEL1 higher than that of the common voltage VCOM during the positive polarity charging period PPCP and the first blank period BLP1. Thus, the first data voltage VDATA1 has a positive polarity with regard to the common voltage VCOM during the positive polarity charging period PPCP. In an exemplary embodiment, the level of the common voltage VCOM may be about 8 volts, and the first level LEVEL1 may be about 16 volts, for example. The second frame period FP2 may include a negative polarity charging period NPCP and a second blank period BLP2 subsequent to the negative polarity charging period NPCP. The first data voltage VDATA1 has a second level LEVEL2 lower than that of the common voltage VCOM during the negative polarity charging period NPCP and the second blank period BLP2. Thus, the first data voltage VDATA1 has a negative polarity with regard to the common voltage VCOM during the negative polarity charging period NPCP. In an exemplary embodiment, the second level LEVEL2 may be about 0 volt, for example.

The first storage voltage VCST1 may be a direct current ("DC") voltage. Specifically, when a frame of the image is a high grayscale frame, a vertical line flicker is less recognized compared to a case in which the frame of the image is a low grayscale frame. Thus, the first storage voltage VCST1 has a third level LEVEL3 between the first level LEVEL1 and the second level LEVEL2 during the positive polarity charging period PPCP, the first blank period BLP1, the negative polarity charging period NPCP and the second blank period BLP2. In an exemplary embodiment, the third level LEVEL3 may be about 5 volts, for example.

A difference between the third level LEVEL3 of the first storage voltage VCST1 and the first level LEVEL1 of the first data voltage VDATA1 is a negative value during the first blank frame period FP1. A difference between the third level LEVEL3 of the first storage voltage VCST1 and the second level LEVEL2 of the first data voltage VDATA1 is a positive value during the second frame period FP2. Here, a difference between a first absolute value of the negative value and a second absolute value of the positive value may be less than a first reference value. In an exemplary embodiment, the first level LEVEL1 may be about 16 volts, the second level LEVEL2 may be about 0 volt, the third level LEVEL3 may be about 5 volts, the negative value may be about −11 volts, the positive value may be about 5 volts, the first absolute value may be about 11 volts, the second absolute value may be about 5 volts, and the first reference value may be about 6 volts, for example.

An effective voltage which is a difference between the first storage voltage VCST1 and the first data voltage VDATA1 is applied to an interface between the first storage line Cst1 and the gate insulating layer 315.

Referring to FIGS. 5, 7 and 11, when the low grayscale frame signal LGFS is provided from the frame dividing part 430 to the voltage providing part 450, the second data voltage VDATA2 may be applied to the source-drain layer 317. In addition, when the low grayscale frame signal LGFS is provided from the frame dividing part 430 to the voltage providing part 450, the second storage voltage VCST2 may be applied to the first storage line Cst1. The second data voltage VDATA2 and the second storage voltage VCST2 may be controlled by the voltage providing part 450.

A polarity of the second data voltage VDATA2 may be changed in each frame period. Specifically, the frame periods may include a first frame period FP1 and a second frame period FP2 subsequent to the first frame period FP1. The first frame period FP1 may include a positive polarity charging period PPCP and a first blank period BLP1 subsequent to the positive polarity charging period PPCP. The second data voltage VDATA2 has a fourth level LEVEL4 higher than that of the common voltage VCOM during the positive polarity charging period PPCP and the first blank period BLP1. Thus, the second data voltage VDATA2 has a positive polarity during the positive polarity charging period PPCP. In an exemplary embodiment, the level of the common voltage VCOM may be about 8 volts, and the fourth level LEVEL4 may be about 9 volts, for example. The second frame period FP2 may include a negative polarity charging period NPCP and a second blank period BLP2 subsequent to the negative polarity charging period NPCP. The second data voltage VDATA2 has a fifth level LEVEL5 lower than that of the common voltage VCOM during the negative polarity charging period NPCP and the second blank period BLP2. Thus, the second data voltage VDATA2 has a negative polarity with regard to the common voltage VCOM during the negative polarity charging period NPCP. In an exemplary embodiment, the fifth level LEVEL5 may be about 7 volt, for example.

The second storage voltage VCST2 may be a DC voltage. Specifically, when a frame of the image is a low grayscale frame, a vertical line flicker is more recognized compared to a case in which the frame of the image is a high grayscale frame. Thus, the second storage voltage VCST2 has a sixth level LEVEL6 higher than the fourth level LEVEL4 and the fifth level LEVEL5 during the positive polarity charging period PPCP, the first blank period BLP1, the negative polarity charging period NPCP and the second blank period BLP2. In an exemplary embodiment, the sixth level LEVEL6 may be about 15 volts, for example. Thus, when the image data DATA of the image is a low grayscale, the second storage voltage VCST2 is higher than the second data voltage VDATA2, and thus the vertical flicker of the display panel 110 may be decreased.

According to the illustrated exemplary embodiment, when the image data DATA of the image is a high grayscale, the effective voltage applied to the interface between the first storage line Cst1 and the gate insulating layer 315 is the negative value during the frame period. In addition, the effective voltage applied to the interface between the first storage line Cst1 and the gate insulating layer 315 is the positive value during the second frame period FP2. In addition, the difference between the first absolute value of the negative value and the second absolute value of the positive value is less than the first reference value. Thus, a charge trapping at the interface between the first storage line Cst1 and the gate insulating layer 315 may be decreased.

Therefore, an afterimage of the image displayed on the display panel 110 may be decreased, and thus display quality of the display apparatus 400 may be improved.

Figure 12:
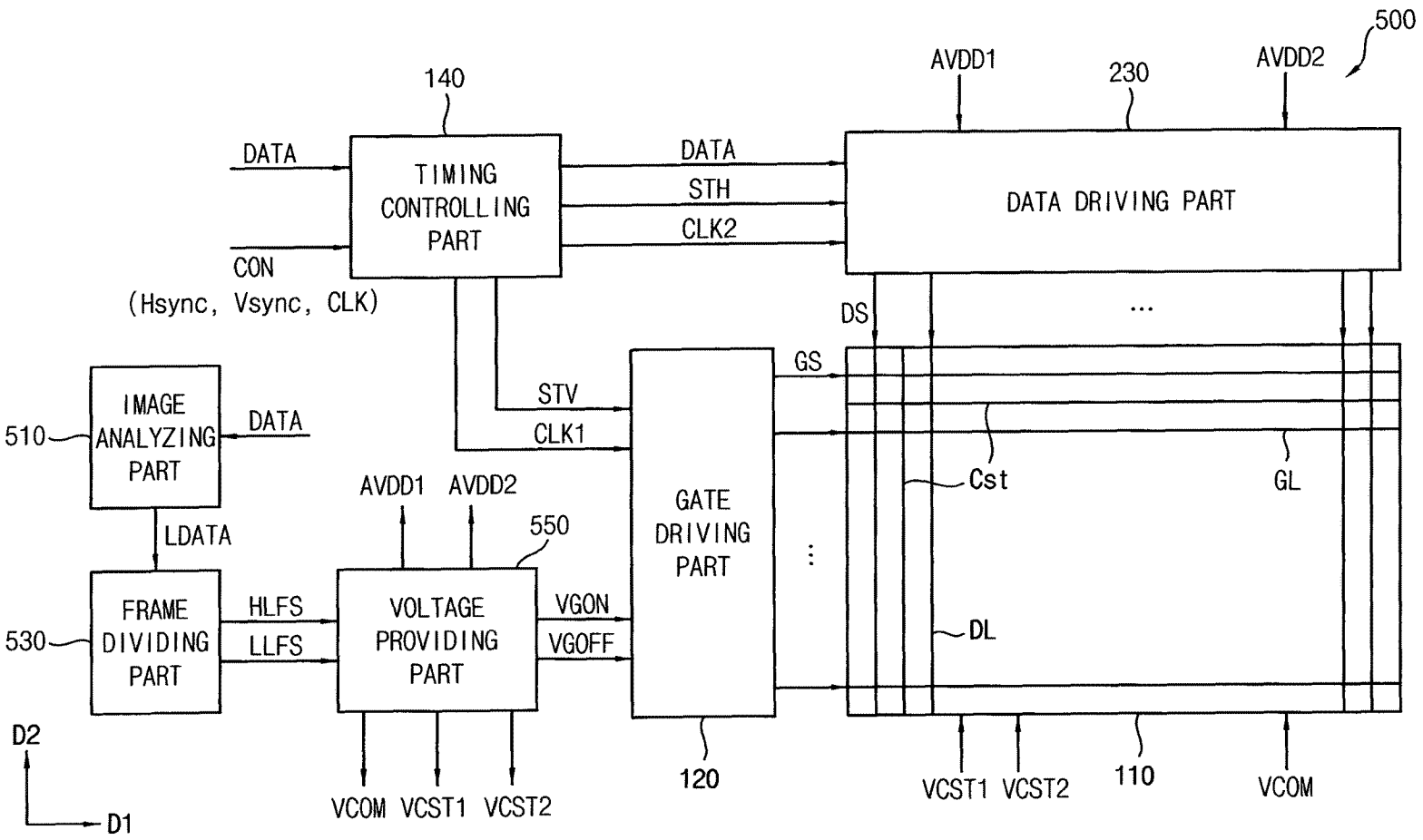
FIG. 12 is a block diagram illustrating an exemplary embodiment of a display apparatus according to the invention.

FIG. 12 is a block diagram illustrating a display apparatus according to an exemplary embodiment of the invention.

The display apparatus 500 according to the illustrated exemplary embodiment is substantially the same as the display apparatus 400 according to the previous exemplary embodiment illustrated in FIG. 7 except for an image analyzing part 510, a frame dividing part 530 and a voltage providing part 550. In addition, the display apparatus 500 according to the illustrated exemplary embodiment is substantially the same as the display apparatus 100 according to the previous exemplary embodiment illustrated in FIG. 1 except for the data driving part 230, the image analyzing part 510, the frame dividing part 530 and the voltage providing part 550. Thus, the same reference numerals may be used to refer to same or like parts as those described in the previous exemplary embodiment and any further repetitive explanation concerning the above elements may be omitted.

Referring to FIGS. 1, 7 and 12, the display apparatus 500 according to the illustrated exemplary embodiment includes the display panel 110, the gate driving part 120, the data driving part 230, the timing controlling part 140, the image analyzing part 510, the frame dividing part 530 and the voltage providing part 550.

The gate driving part 120, the data driving part 230, the timing controlling part 140, the image analyzing part 510, the frame dividing part 530 and the voltage providing part 550 may be defined as a display panel driving apparatus driving the display panel 110.

The gate driving part 120 generates the gate signal GS in response to the gate start signal STV and the gate clock signal CLK1 provided from the timing controlling part 140, and outputs the gate signal GS to the gate line GL. The gate driving part 120 may generate the gate signal GS using a gate on voltage VGON and a gate off voltage VGOFF provided from the voltage providing part 550.

The data driving part 230 outputs the data signal DS to the data line DL in response to the data start signal STH and the data clock signal CLK2 provided from the timing controlling part 140. The data driving part 230 may output the data signal DS using a first data driving voltage AVDD1 and a second data driving voltage AVDD2 provided from the voltage providing part 550.

The image analyzing part 510 receives the image data DATA, and analyzes a luminance of the image data DATA to output a luminance data LDATA. In an exemplary embodiment, the image analyzing part 510 may analyze a grayscale of the image data DATA and calculate a luminance corresponding to the grayscale to output the luminance data LDATA, for example. The image analyzing part 510 may receive the image data DATA from an outside or the timing controlling part 140.

The frame dividing part 530 receives the luminance data LDATA from the image analyzing part 510. The frame dividing part 530 outputs a high luminance frame signal HLFS based on the luminance data LDATA when a frame of the image data DATA has a luminance value higher than an average luminance value of the image data DATA. In addition, the frame dividing part 530 outputs a low luminance frame signal LLFS based on the luminance data LDATA when the frame of the image data DATA has a luminance value lower than the average luminance value of the image data DATA.

The voltage providing part 550 outputs the gate on voltage VGON and the gate off voltage VGOFF to the gate driving part 120. In addition, the voltage providing part 550 outputs the first data driving voltage AVDD1 to the data driving part 230 when the voltage providing part 550 receives the high luminance frame signal HLFS from the frame dividing part 530. In addition, the voltage providing part 550 outputs the second data driving voltage AVDD2 to the data driving part 230 when the voltage providing part 550 receives the low luminance frame signal LLFS from the frame dividing part 530. In addition, the voltage providing part 550 outputs a first storage voltage VCST1 to the storage line Cst of the display panel 110 when the voltage providing part 550 receives the high luminance frame signal HLFS from the frame dividing part 530. In addition, the voltage providing part 550 outputs a second storage voltage VCST2 to the storage line Cst of the display panel 110 when the voltage providing part 550 receives the low luminance frame signal LLFS from the frame dividing part 530. In addition, the voltage providing part 550 outputs a common voltage VCOM to a common electrode in the display panel 110.

The display panel 110 according to the illustrated exemplary embodiment is substantially the same as the display panel 110 of FIG. 1. Thus, the display panel 110 may include the base substrate 101, the first storage line Cst1, the gate insulating layer 315, the channel layer 316 and the source-drain layer 317 shown in FIG. 5.

When the high luminance frame signal HLFS is provided from the frame dividing part 530 to the voltage providing part 550, a waveform diagram illustrating a first data voltage of the data signal DS, the first storage voltage VCST1 applied to the storage line Cst and the common voltage VCOM applied to the common electrode in the display panel 110 is substantially the same as the waveform diagram of FIG. 8.

Thus, referring to FIGS. 5, 8 and 12, the first data voltage VDATA1 may be applied to the source-drain layer 317. The first storage voltage VCST1 may be applied to the first storage line Cst1. The first data voltage VDATA1 and the first storage voltage VCST1 may be controlled by the voltage providing part 550.

A polarity of the first data voltage VDATA1 may be changed in each frame period. Specifically, the frame periods may include a first frame period FP1 and a second frame period FP2 subsequent to the first frame period FP1. The first frame period FP1 may include a positive polarity charging period PPCP and a first blank period BLP1 subsequent to the positive polarity charging period PPCP. The first data voltage VDATA1 has a first level LEVEL1 higher than that of the common voltage VCOM during the positive polarity charging period PPCP and the first blank period BLP1. Thus, the first data voltage VDATA1 has a positive polarity with regard to the common voltage VCOM during the positive polarity charging period PPCP. In an exemplary embodiment, the level of the common voltage VCOM may be about 8 volts, and the first level LEVEL1 may be about 16 volts, for example. The second frame period FP2 may include a negative polarity charging period NPCP and a second blank period BLP2 subsequent to the negative polarity charging period NPCP. The first data voltage VDATA1 has a second level LEVEL2 lower than that of the common voltage VCOM during the negative polarity charging period NPCP and the second blank period BLP2. Thus, the first data voltage VDATA1 has a negative polarity with regard to the common voltage VCOM during the negative polarity charging period NPCP. In an exemplary embodiment, the second level LEVEL2 may be about 0 volt, for example.

The first storage voltage VCST1 may be an AC voltage. Specifically, the first storage voltage VCST1 has a third level LEVEL3 during the positive polarity charging period PPCP and the negative polarity charging period NPCP and has a fourth level LEVEL4 lower than the third level LEVEL3 and between the first level LEVEL1 and the second level LEVEL2 during the first blank period BLP1 and the second blank period BLP2. In an exemplary embodiment, the third level LEVEL3 may be about 15 volts, and the fourth level LEVEL4 may be 5 volts, for example.

A difference between the fourth level LEVEL4 of the first storage voltage VCST1 and the first level LEVEL1 of the first data voltage VDATA1 is a negative value during the first blank period BLP1. A difference between the fourth level LEVEL4 of the first storage voltage VCST1 and the second level LEVEL2 of the first data voltage VDATA1 is a positive value during the second blank period BLP2. Here, a difference between a first absolute value of the negative value and a second absolute value of the positive value may be less than a first reference value. In an exemplary embodiment, the first level LEVEL1 may be about 16 volts, the second level LEVEL2 may be about 0 volt, the fourth level LEVEL4 may be about 5 volts, the negative value may be about −11 volts, the positive value may be about 5 volts, the first absolute value may be about 11 volts, the second absolute value may be about 5 volts, and the first reference value may be about 6 volts, for example.

A first effective voltage which is a difference between the first storage voltage VCST1 and the first data voltage VDATA1 is applied to an interface between the first storage line Cst1 and the gate insulating layer 315.

When the low luminance frame signal LLFS is provided from the frame dividing part 530 to the voltage providing part 550, a waveform diagram illustrating a second data voltage of the data signal DS, the second storage voltage VCST2 applied to the storage line Cst and the common voltage VCOM applied to the common electrode in the display panel 110 is substantially the same as the waveform diagram of FIG. 9.

Thus, referring to FIGS. 5, 9 and 12, the second data voltage VDATA2 may be applied to the source-drain layer 317. The second storage voltage VCST2 may be applied to the first storage line Cst1. The second data voltage VDATA2 and the second storage voltage VCST2 may be controlled by the voltage providing part 550.

A polarity of the second data voltage VDATA2 may be changed in each frame period. Specifically, the frame periods may include a first frame period FP1 and a second frame period FP2 subsequent to the first frame period FP1. The first frame period FP1 may include a positive polarity charging period PPCP and a first blank period BLP1 subsequent to the positive polarity charging period PPCP. The second data voltage VDATA2 has a fifth level LEVEL5 higher than that of the common voltage VCOM during the positive polarity charging period PPCP. Thus, the second data voltage VDATA2 has a positive polarity during the positive polarity charging period PPCP. In an exemplary embodiment, the level of the common voltage VCOM may be about 8 volts, and the fifth level LEVEL5 may be about 9 volts, for example. The second data voltage VDATA2 has a sixth level LEVEL6 higher than the fifth level LEVEL5 during the first blank period BLP1. In an exemplary embodiment, the sixth level LEVEL6 may be about 16 volts, for example. The second frame period FP2 may include a negative polarity charging period NPCP and a second blank period BLP2 subsequent to the negative polarity charging period NPCP. The second data voltage VDATA has a seventh level LEVEL7 lower than that of the common voltage VCOM during the negative polarity charging period NPCP. Thus, the second data voltage VDATA2 has a negative polarity with regard to the common voltage VCOM during the negative polarity charging period NPCP. In an exemplary embodiment, the seventh level LEVEL7 may be about 7 volts, for example. The second data voltage VDATA2 has an eighth level LEVEL8 during the second blank period BLP2. In an exemplary embodiment, the eighth level LEVEL8 may be about 0 volt, for example.

The second storage voltage VCST2 may be an AC voltage. Specifically, the second storage voltage VCST2 has a ninth level LEVEL9 during the positive polarity charging period PPCP and the negative polarity charging period NPCP and has a tenth level LEVEL10 lower than the ninth level LEVEL9 and between the sixth level LEVEL6 and the eighth level LEVEL8 during the first blank period BLP1 and the second blank period BLP2. In an exemplary embodiment, the ninth level LEVEL5 may be about 15 volts, and the tenth level LEVEL10 may be 5 volts, for example.

A difference between the tenth level LEVEL10 of the second storage voltage VCST2 and the sixth level LEVEL6 of the second data voltage VDATA2 is a negative value during the first blank period BLP1. A difference between the tenth level LEVEL10 of the second storage voltage VCST2 and the eighth level LEVEL8 of the second data voltage VDATA2 is a positive value during the second blank period BLP2. Here, a difference between a third absolute value of the negative value and a fourth absolute value of the positive value may be less than a second reference value. In an exemplary embodiment, the sixth level LEVEL6 may be about 16 volts, the eighth level LEVEL8 may be about 0 volt, the tenth level LEVEL10 may be about 5 volts, the negative value may be about −11 volts, the positive value may be about 5 volts, the third absolute value may be about 11 volts, the fourth absolute value may be about 5 volts, and the second reference value may be about 6 volts, for example.

A second effective voltage which is a difference between the second storage voltage VCST2 and the second data voltage VDATA2 is applied to an interface between the first storage line Cst1 and the gate insulating layer 315.

According to the illustrated exemplary embodiment, the first effective voltage applied to the interface between the first storage line Cst1 and the gate insulating layer 315 is the negative value during the first blank period BLP1. In addition, the first effective voltage applied to the interface between the first storage line Cst1 and the gate insulating layer 315 is the positive value during the second blank period BLP2. In addition, the difference between the first absolute value of the negative value and the second absolute value of the positive value is less than the first reference value. Thus, a charge trapping at the interface between the first storage line Cst1 and the gate insulating layer 315 may be decreased.

In addition, the second effective voltage applied to the interface between the first storage line Cst1 and the gate insulating layer 315 is the negative value during the first blank period BLP1. In addition, the second effective voltage applied to the interface between the first storage line Cst1 and the gate insulating layer 315 is the positive value during the second blank period BLP2. In addition, the difference between the third absolute value of the negative value and the fourth absolute value of the positive value is less than the second reference value. Thus, a charge trapping at the interface between the first storage line Cst1 and the gate insulating layer 315 may be decreased Therefore, an afterimage of the image displayed on the display panel 110 may be decreased, and thus display quality of the display apparatus 500 may be improved.

According to a display apparatus, an afterimage of an image displayed on a display panel may be decreased, and thus display quality of a display apparatus may be improved.

The foregoing is illustrative of the invention and is not to be construed as limiting thereof. Although a few exemplary embodiments of the invention have been described, those skilled in the art will readily appreciate that many modifications are possible in the exemplary embodiments without materially departing from the novel teachings and advantages of the invention. Accordingly, all such modifications are intended to be included within the scope of the invention as defined in the claims. In the claims, means-plus-function clauses are intended to cover the structures described herein as performing the recited function and not only structural equivalents but also equivalent structures. Therefore, it is to be understood that the foregoing is illustrative of the invention and is not to be construed as limited to the specific exemplary embodiments disclosed, and that modifications to the disclosed exemplary embodiments, as well as other exemplary embodiments, are intended to be included within the scope of the appended claims. The invention is defined by the following claims, with equivalents of the claims to be included therein.

What is claimed is:

1. A display apparatus comprising:

a display panel including a gate line, a data line and a storage line, and displaying an image;

a gate driving part configured to output a gate signal to the gate line;

a data driving part configured to output a data signal based on an image data of the image to the data line; and a voltage providing part configured to apply an alternating current voltage to the storage line, wherein a polarity of a data voltage output as the data signal is changed each frame period of a plurality of frame periods, the plurality of frame periods includes a first frame period and a second frame period subsequent to the first frame period, the first frame period includes a positive polarity charging period and a first blank period subsequent to the positive polarity charging period, the second frame period includes a negative polarity charging period and a second blank period subsequent to the negative polarity charging period, and the data voltage has a first level of a positive polarity during the positive polarity charging period, has a second level of a negative polarity during the negative polarity charging period, and has the first level during the first blank period and the second blank period.

2. The display apparatus of claim 1, wherein the display panel further includes a first unit pixel including a first pixel and a second pixel, and a second unit pixel including a third pixel and a fourth pixel, and each of the first unit pixel and the second unit pixel includes:

a first thin film transistor electrically connected to the gate line and the data line, overlapping the storage line and electrically connected to a first pixel electrode of the first pixel;

a second thin film transistor electrically connected to the gate line and the data line and electrically connected to a second pixel electrode of the second pixel; and a third thin film transistor electrically connected to the gate line and the second thin film transistor and electrically connected to the second pixel electrode of the second pixel.

3. The display apparatus of claim 2, wherein the first pixel is a red pixel, the second pixel is a green pixel, the third pixel is a blue pixel and the fourth pixel is a white pixel.

4. The display apparatus of claim 2, wherein the storage line includes a first storage line extending in a first direction in which the gate line extends, and a second storage line extending in a second direction in which the data line extends, and the third thin film transistor is electrically connected to the second storage line.

5. The display apparatus of claim 2, wherein the display panel further comprises a gate insulating layer disposed on the storage line, a channel layer disposed on the gate insulating layer, and a source-drain layer disposed on the channel layer.

6. The display apparatus of claim 5, wherein the positive polarity and the negative polarity are with reference to a common voltage.

7. The display apparatus of claim 6, wherein a storage voltage applied to the storage line has a third level during the positive polarity charging period and the negative polarity charging period, and has a fourth level lower than the third level and between the first level and the second level during the first blank period and the second blank period.

8. The display apparatus of claim 7, wherein a difference between the fourth level of the storage voltage and the first level of the data voltage is a negative value during the first blank period and the second blank period, and a difference between the third level of the storage voltage and the second level of the data voltage is a positive value during the negative polarity charging period.

9. The display apparatus of claim 8, wherein a difference between a first absolute value of the negative value and a second absolute value of the positive value is less than a reference value.

10. The display apparatus of claim 9, wherein the first level is about 16 volts, the second level is about 0 volt, the third level is about 15 volts, the fourth level is about 5 volts, and the reference value is about 5 volts.

11. A display apparatus comprising:

a display panel including a gate line, a data line and a storage line, and displaying an image;

a gate driving part configured to output a gate signal to the gate line;

a data driving part configured to output a data signal based on an image data of the image to the data line;

a voltage providing part configured to apply an alternating current voltage to the storage line an image analyzing part configured to analyze a grayscale of the image data and output a grayscale data; and a frame dividing part configured to output a high grayscale frame signal which indicates a frame having a grayscale value higher than an average grayscale value of the image data and a low grayscale frame signal which indicates a frame having a grayscale value lower than the average grayscale value of the image data, based on the grayscale data, wherein the voltage providing part applies the alternating current voltage to the storage line in response to the high grayscale frame signal and applies the alternating current voltage to the storage line in response to the low grayscale frame signal.

12. The display apparatus of claim 11, wherein the display panel further includes a gate insulating layer disposed on the storage line, a channel layer disposed on the gate insulating layer, and a source-drain layer disposed on the channel layer, and a polarity of a data voltage applied to the source-drain layer is changed in each of frame periods.

13. The display apparatus of claim 12, wherein the frame periods includes a first frame period and a second frame period subsequent to the first frame period, the first frame period includes a positive polarity charging period and a first blank period subsequent to the positive polarity charging period, the second frame period includes a negative polarity charging period and a second blank period subsequent to the negative polarity charging period, and when the frame dividing part outputs the high grayscale frame signal, the data voltage has a first level of a positive polarity during the positive polarity charging period and the first blank period, and has a second level of a negative polarity during the negative polarity charging period and the second blank period, and a storage voltage applied to the storage line has a third level during the positive polarity charging period and the negative polarity charging period and has a fourth level lower than the third level and between the first level and the second level during the first blank period and the second blank period, wherein the positive polarity and the negative polarity are with reference to a common voltage.

14. The display apparatus of claim 13, wherein a difference between the fourth level of the storage voltage and the first level of the data voltage is a negative value during the first blank period, and a difference between the fourth level of the storage voltage and the second level of the data voltage is a positive value during the second blank period.

15. The display apparatus of claim 13, wherein, when the frame dividing part outputs the low grayscale frame signal, the data voltage has a fifth level of the positive polarity during the positive polarity charging period, has a sixth level higher than the fifth level during the first blank period, has a seventh level of the negative polarity during the negative polarity charging period, and has an eighth level lower than the seventh level during the second blank period, and the storage voltage has a ninth level during the positive polarity charging period and the negative polarity charging period, and has a tenth level lower than the ninth level and between the sixth level and the eighth level during the first blank period and the second blank period.

16. The display apparatus of claim 15, wherein a difference between the tenth level of the storage voltage and the sixth level of the data voltage is a negative value during the first blank period, and a difference between the tenth level of the storage voltage and the eighth level of the data voltage is a positive value during the second blank period.

17. The display apparatus of claim 12, wherein the frame periods includes a first frame period and a second frame period subsequent to the first frame period, the first frame period includes a positive polarity charging period and a first blank period subsequent to the positive polarity charging period, the second frame period includes a negative polarity charging period and a second blank period subsequent to the negative polarity charging period, and when the frame dividing part outputs the high grayscale frame signal, the data voltage has a first level of a positive polarity during the positive polarity charging period and the first blank period, and has a second level of a negative polarity during the negative polarity charging period and the second blank period, and a storage voltage applied to the storage line has a third level between the first level and the second level during the positive polarity charging period, the first blank period, the negative polarity charging period and the second blank period, wherein the positive polarity and the negative polarity are with reference to a common voltage.

18. The display apparatus of claim 17, wherein, when the frame dividing part outputs the low grayscale frame signal, the data voltage has a fourth level of the positive polarity during the positive polarity charging period and the first blank period, and has a fifth level of the negative polarity during the positive polarity charging period and the second blank period, and the storage voltage has a sixth level higher than the fourth level and the fifth level during the positive polarity charging period, the first blank period, the negative polarity charging period and the second blank period.

19. A display apparatus comprising:

a display panel including a gate line, a data line and a storage line, and displaying an image;

a gate driving part configured to output a gate signal to the gate line;

a data driving part configured to output a data signal based on an image data of the image to the data line;

a voltage providing part configured to apply an alternating current voltage to the storage line an image analyzing part configured to analyze a luminance of the image data and output a luminance data; and a frame dividing part configured to output a high luminance frame signal which indicates a frame having a luminance value higher than an average luminance value of the image data and a low luminance frame signal which indicates a frame having a luminance value lower than the average luminance value of the image data, based on the luminance data, wherein the voltage providing part applies the alternating current voltage to the storage line in response to the high luminance frame signal and applies the alternating current voltage to the storage line in response to the low luminance frame signal.

* * * * *